United States Patent [19]

Minnie, Jr. et al.

[11] Patent Number: 4,568,576

[45] Date of Patent: Feb. 4, 1986

[54] METAL COATING PROCESS AND APPARATUS

[76] Inventors: Clarence O. Minnie, Jr., 22542 Maywood, Apt. 4108, Farmington Hills, Mich. 48024; Edward E. Tomblin, 16765 Truwood, Woodhaven, Mich. 48183

[21] Appl. No.: 616,618

[22] Filed: Jun. 4, 1984

[51] Int. Cl.[4] ..... B05D 7/14; B05C 3/10

[52] U.S. Cl. ..... 427/430.1; 427/435; 118/425; 118/429

[58] Field of Search ..... 118/425, 429, 421; 427/435, 430.1

[56] References Cited

U.S. PATENT DOCUMENTS

| | | | |
|---|---|---|---|
| 3,839,988 | 10/1974 | Duerr | 148/6.15 R X |
| 4,062,990 | 12/1977 | Coch | 148/6.15 R |
| 4,196,023 | 4/1980 | Rowe | 118/316 X |
| 4,402,765 | 9/1983 | Goto et al. | 148/6.15 R |
| 4,442,588 | 4/1984 | Omata | 118/425 |
| 4,483,270 | 11/1984 | Toya et al. | 118/421 X |
| 4,483,271 | 11/1984 | Eidschun et al. | 118/326 X |

*Primary Examiner*—Shrive P. Beck

*Attorney, Agent, or Firm*—Krass and Young

[57] ABSTRACT

A method and apparatus for subjecting articles to surface treatment of a sequence of solutions utilizing a plurality of process tanks and a plurality of supply tanks, each supply tank containing one of the solutions utilized in the process. The process tanks and supply tanks are interconnected by conduit means which include a series of valves which may be activated and deactivated for routing the solution to and from any of the selected tanks. The valves are automatically activated and deactivated by a programmable control which allows for articles introduced into each of the process tanks to be subjected to each of the solutions in a programmed sequence.

10 Claims, 6 Drawing Figures

METAL COATING PROCESS AND APPARATUS

TECHNICAL FIELD

This invention relates generally to the surface treating of manufactured articles and, in particular, to a method and apparatus for applying a series of chemical coatings to automobile body panels.

BACKGROUND ART

The use of process tanks in connection with the coating of articles, in particular metal parts, is well known in the art. The articles are typically positioned within the confines of the tanks and are sprayed with or completely immersed in the chemical solution while in the tank.

The use of immersion tanks in connection with the conveyor line treatment of automobile bodies is disclosed in U.S. Pat. No. 4,196,023, issued to Arthur J. Rowe. Rowe discloses a method for preparing automobile bodies on a conveyor line which utilzes one or more elongate immersion tanks positioned along the assembly line. As the automobile bodies travel on the conveyor line they are routed into the elongate tanks and immersed in the chemical solutions contained in the tanks, pulled out of the tank and moved by the conveyor line to the next stop in the assembly process. When the auto bodies are to be immersed in a series of chemical solutions, the immersion tanks containing these solutions are generally arranged in end-to-end fashion along the conveyor line. One problem with this multiple tank system is that the automobile bodies carry contaminants from one tank to another, resulting in the contamination of the chemical solutions contained in the subsequent tanks. In addition, there is usually a specific processing time associated with each of the chemical solutions. Thus, the tanks must be of sufficient length to ensure that the automobile bodies are exposed to the solution for the appropriate processing time when these bodies are moved at a specified rate by the conveyor line. These tanks occupy a large amount of floor space and require a relatively large volume of chemical solution for each process.

Another problem with conveyor line production system is that the line often shuts down for various reasons. When the line is stopped, the automobile bodies that are currently undergoing treatment in one of the chemical solutions must be removed from the tank after a certain amount of time and accumulated alongside the conveyor until the conveyor restarts. Thus, a large area must be provided for the off-line accumulation of articles undergoing a chemical processing in the event of a conveyor line shutdown.

The present invention is directed to overcoming the problems set forth above.

SUMMARY OF THE INVENTION

In accordance with one aspect of the present invention, an apparatus for subjecting articles to surface treatment of a sequence of solutions employs a plurality of process tanks into which the parts are placed for treatment, a plurality of supply tanks, each containing one of the solutions utilized in the process, and means for supplying and removing each of the solutions into each of the tanks in the desired sequence.

In the preferred embodiment, conveyor means are employed for routing the next untreated automobile body received on the principal conveyor line to an open process tank. Thus, a number of automobile bodies equal to the number of process tanks is simultaneously processed, pulled from each of the process tanks and returned to the normal conveyor line queue after processing.

Each of the process tanks is connected to each of the supply tanks by a network of pipes. These pipes are provided with valves to facilitate the selective routing of a particular solution to any one or more of the process tanks while a different chemical solution is simultaneously routed to other selected process tanks.

Each of the process tanks is provided with both rapid supply pipes and a series of spray nozzles. Thus, if it is desired that the part be immersed in the solution, the solution can be routed through the rapid supply pipe into the process tank in order to fill the tank to the appropriate level. If it is desired that the part be sprayed with a particular solution, the solution may be routed through the supply lines that feed the spray nozzles on the process tanks. In this manner a part may be sprayed with a particular solution or completely immersed in that or a different solution depending upon the requirements of the process.

The solutions are discharged from each of the process tanks through a second conduit network. This second conduit network also employs a series of valves which facilitate the selective removal of solution from any one or more of the process tanks to its appropriate supply tank. These valves may also be connected to a programmable controller which automatically activates the valve to divert a selected portion of the discharging chemical solution to another tank.

It will be appreciated by those skilled in the art that the Applicant's invention provides several advantages over a typical serial process. Because the auto bodies are not dragged inline through the tanks, the process tanks need only be slightly larger than the size of the parts being treated. These smaller process tanks require as little as 14% of the volume of chemical solution required by a typical serial processing tank, greatly reducing the fluid cost, the energy cost for heating the chemical solutions and the cost of disposal of the contaminated solution. Since the conduit network supplying the process tanks with the solutions allows for different solutions to be supplied to each of the process tanks at different times, the processing schedules of the process tanks may be staggered relative to each other. This staggered processing allows for a smooth transition of automobile bodies from the serial conveyor into and out of the chemical processing system. Also, since only a fraction of the process tanks might require a specific solution at one time, the total volume of a particular solution required for the entire process is far less than the total volume of each of the process tanks.

An additional advantage is gained by employing an automatic programmable controller to operate selected valves in the pipe network used to discharge the chemical solutions from the process tanks. This programmable controller allows for selected portions of a particular solution being discharged from the process tank to be routed first to one supply tank (or to the sewer), then to another supply tank. This is particularly useful for routing the highly contaminated portion of a discharged chemical solution for disposal and automatically saving the less contaminated portion for recycling through the system.

DESCRIPTION OF THE PREFERRED EMBODIMENT

Figure 1:
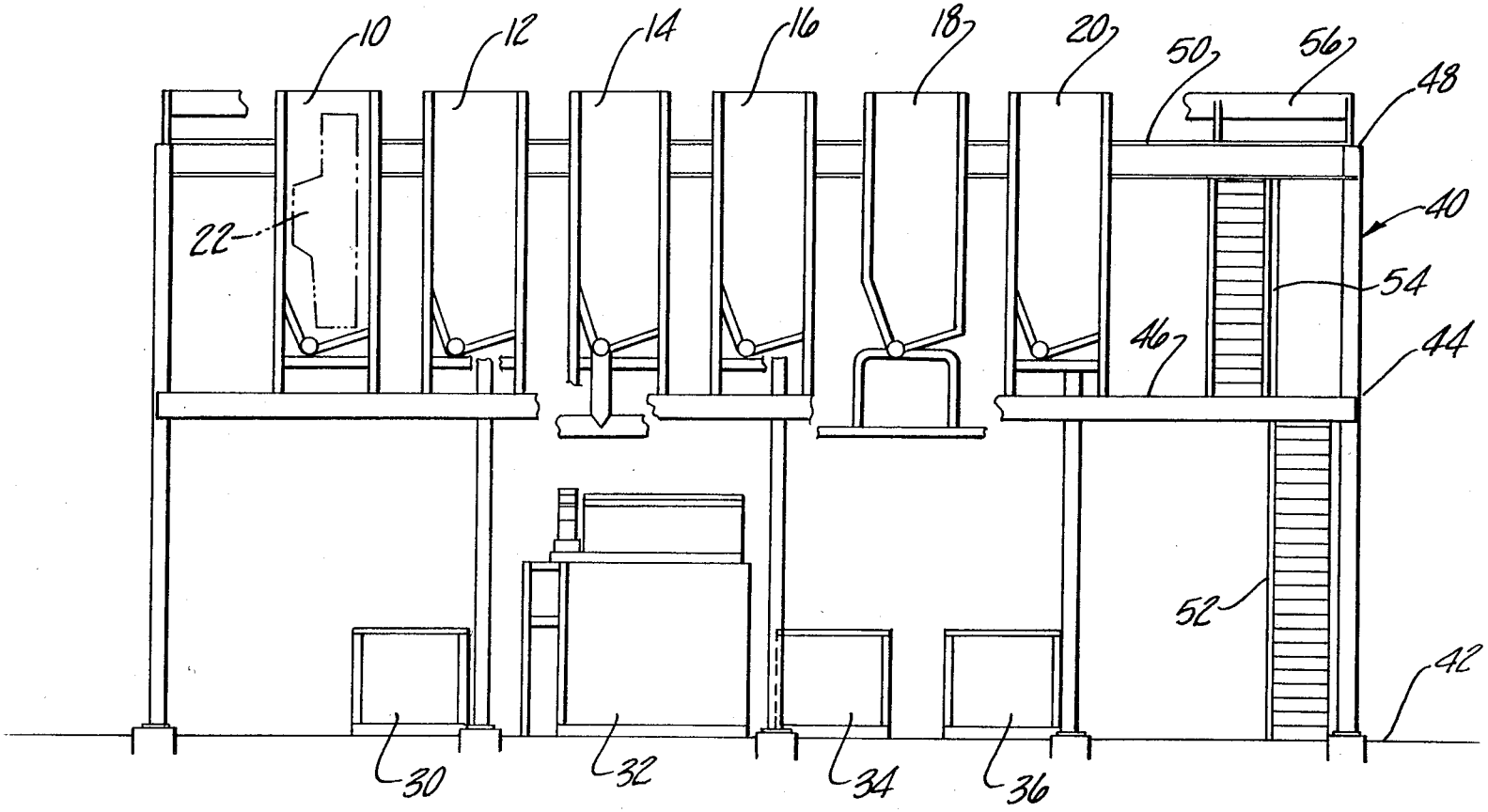
FIG. 1 is an elevational view of a chemical processing facility according to the present invention.

Referring to FIG. 1, a chemical processing facility according to the present invention employs a plurality of process tanks 10–20, a plurality of supply tanks 30–36, and a multi-level skeletal support structure 40. Each of the process tanks 10–20 is slightly larger than the part that is to be treated therein. In the preferred embodiment, the process tanks 10–20 are of sufficient size to accommodate an automobile body 22. It should be noted that providing process tanks 10–20 slightly larger than the parts to be treated is advantageous for several reasons. First, a smaller volume requires a smaller volume of each of the solutions utilized in the process. Also, these relatively smaller process tanks require less factory floor space than conventional dipping tanks. While six tanks are shown in the figure, the number may vary according to such manufacturing constraints as the speed at which the conveyor line supplies the processing facility with automobile bodies, the total processing time for each part, the volume of solution needed to service the tanks, and efficient usage of factory floor space.

Each of the supply tanks 30–36 contains a particular solution which is utilized in the process. In the preferred embodiment, a number of auto body treating solutions are utilized. These include chromic acid rinse, chromic acid, cleaner rinse, cleaner, phosphate, phosphate rinse and D.I. water. At least one of the supply tanks 32 will typically contain a cleaning solution which may be applied to the parts between application of certain of the solutions or at the end of the process. The volume of the supply tanks 30–36 will vary according to the number of process tanks which will simultaneously utilize that particular solution, and the rate of contamination of the solution.

In the preferred embodiment, the metal support structure 40 comprises three levels. The supply tanks 30–36 are mounted on the floor level. The process tanks 10–20 are mounted on the second level 44. A walkway 46 on the second level 44 provides operators access to the supply and drainage pipes located at the bottom of each of the process tanks 10–20. A walkway 50 is also provided on the third level 48, near the top of the process tanks 10–20 to allow the operators access to the inside of the process tanks 10–20 and to parts being treated. In the preferred embodiment, the support structure 40 includes stairways 52 and 54 which provide easy access to each of the upper levels and safety railing 56 on either or both of the upper levels. It should be noted that this multi-level structure greatly reduces the factory floor space required for the system.

Figure 2:
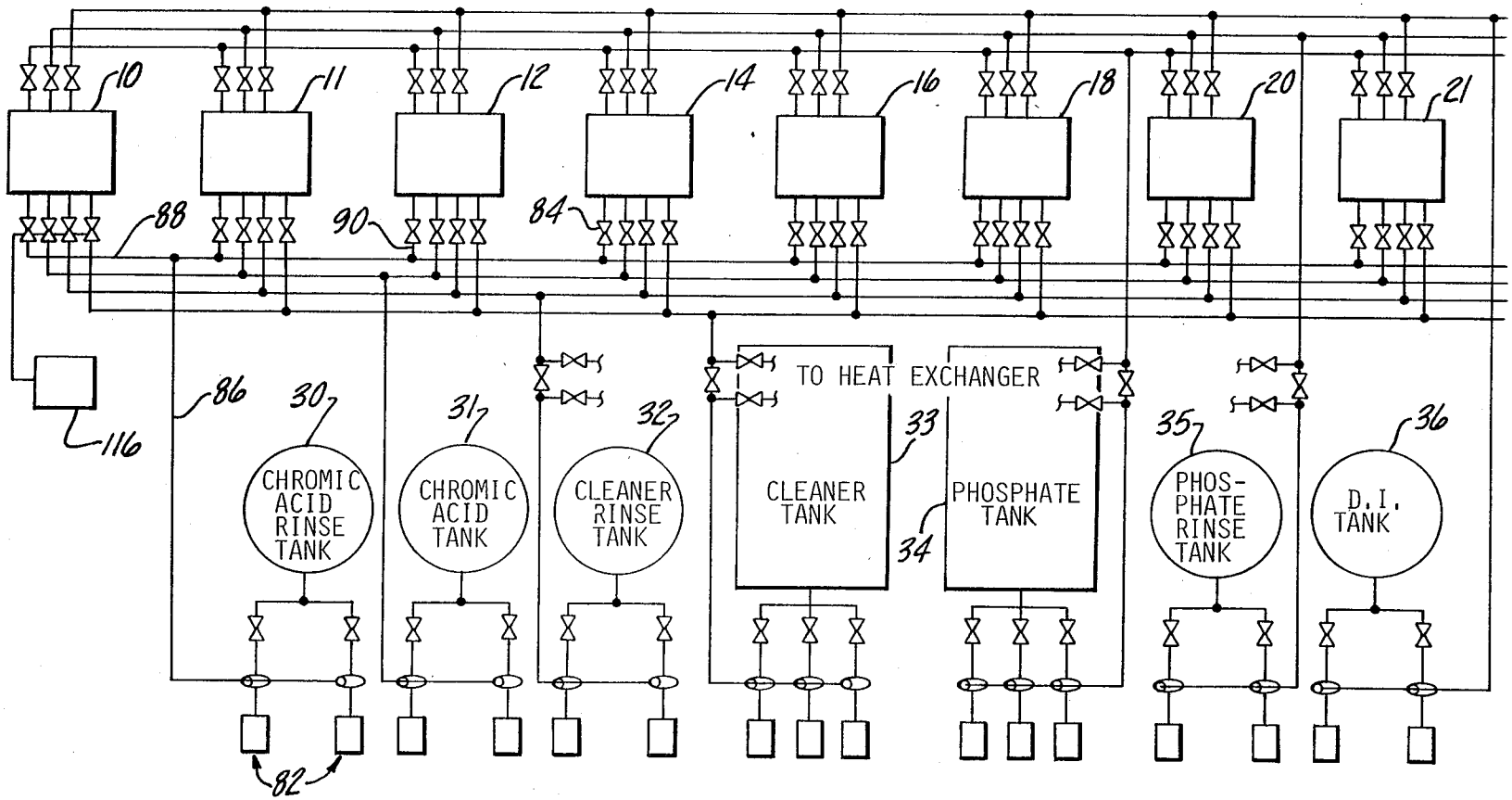
FIG. 2 is a schematic of the supply conduit network.

Referring to FIG. 2, a pipe network 80 is provided for supplying each of the chemicals contained in the supply tanks 30–36 to each of the process tanks 10–21. The chemical solutions may be conveyed through the pipe network by means of conventional pumps 82. Each of the supply tanks 30–36 is connected to at least one principal supply line which in turn is joined to connector lines at each of the process tanks. For example, the chromic acid rinse supply tank 30 is connected by a feeder pipe 86 to its principal supply pipe 88. The principal supply pipe for the chromic acid rinse is then connected to each of the process tanks by means of a connector pipe 90. Valve means, preferably butterfly valve 84, is mounted on each of the connector pipes 90 for each of the process tanks 10–21. The butterfly valve 84 on a particular connector pipe 90 for a particular process tank may be opened or closed independently. Thus, for example, the chromic acid rinse solution in supply tank 30 may be pumped through feeder pipe 86 and principal supply pipe 88 and into any one or more of the process tanks 10–21 by opening the butterfly valve 84 on the connector pipe 90 corresponding to that process tank. As shown by the schematic in FIG. 2, each of the supply tanks has its own feeder pipe, principal supply pipe, and connector pipe to each of the process tanks 10–21. Thus, by selective operation of the appropriate butterfly valves 84, any one or more of the process tanks 10–21 may be supplied with a particular chemical solution while another of the process tanks 10–21 is supplied with a different chemical solution. By staggering the processing cycles in each of the process tanks 10–21 so that different chemical solutions are simultaneously used in different process tanks, significantly less volume of each chemical solution is needed to supply the tanks then would be needed if all of the tanks simultaneously used the same chemical solution.

Figure 4:
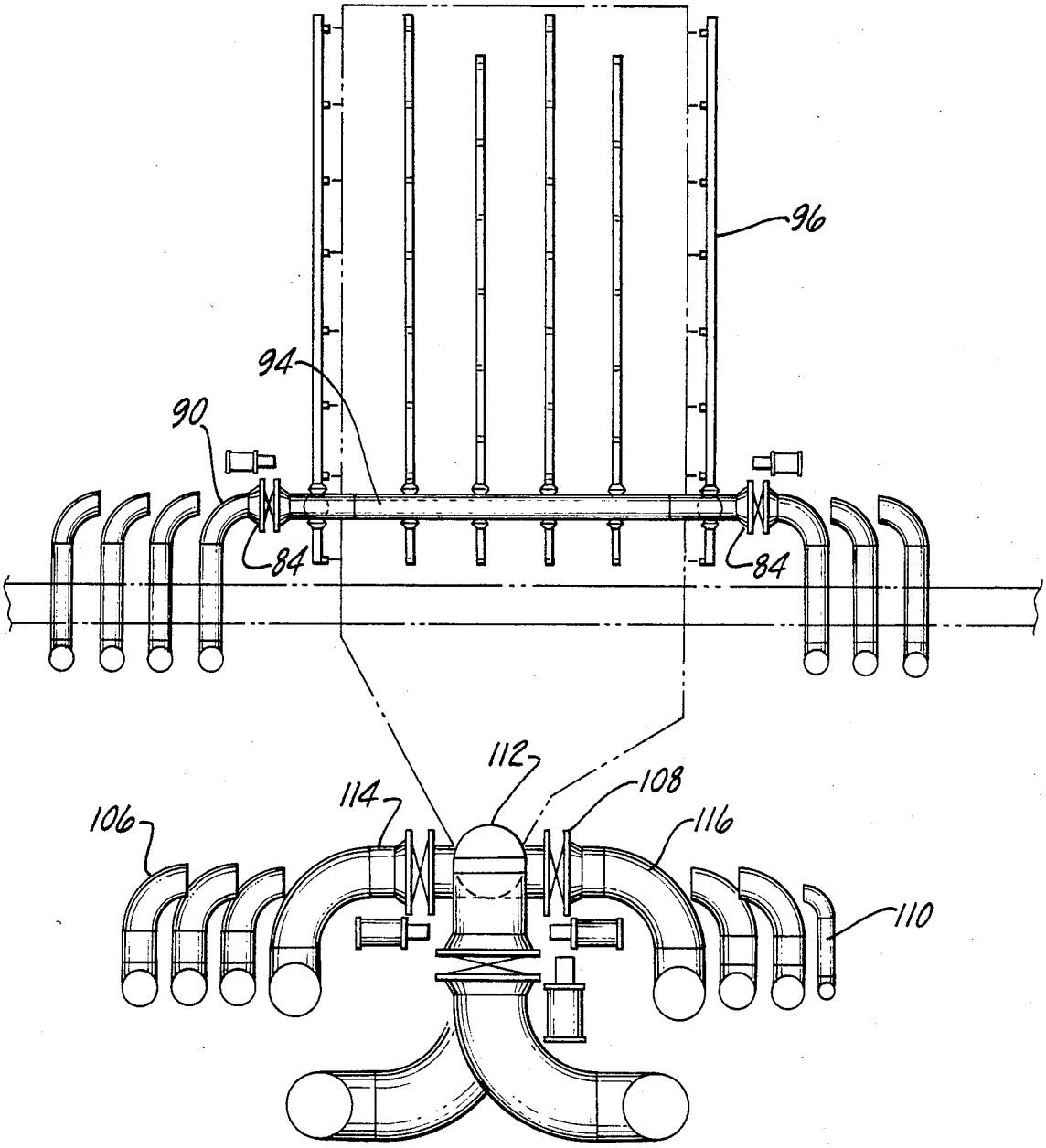
FIG. 4 is a side view of a process tank utilized in the chemical processing facility.
Figure 5:
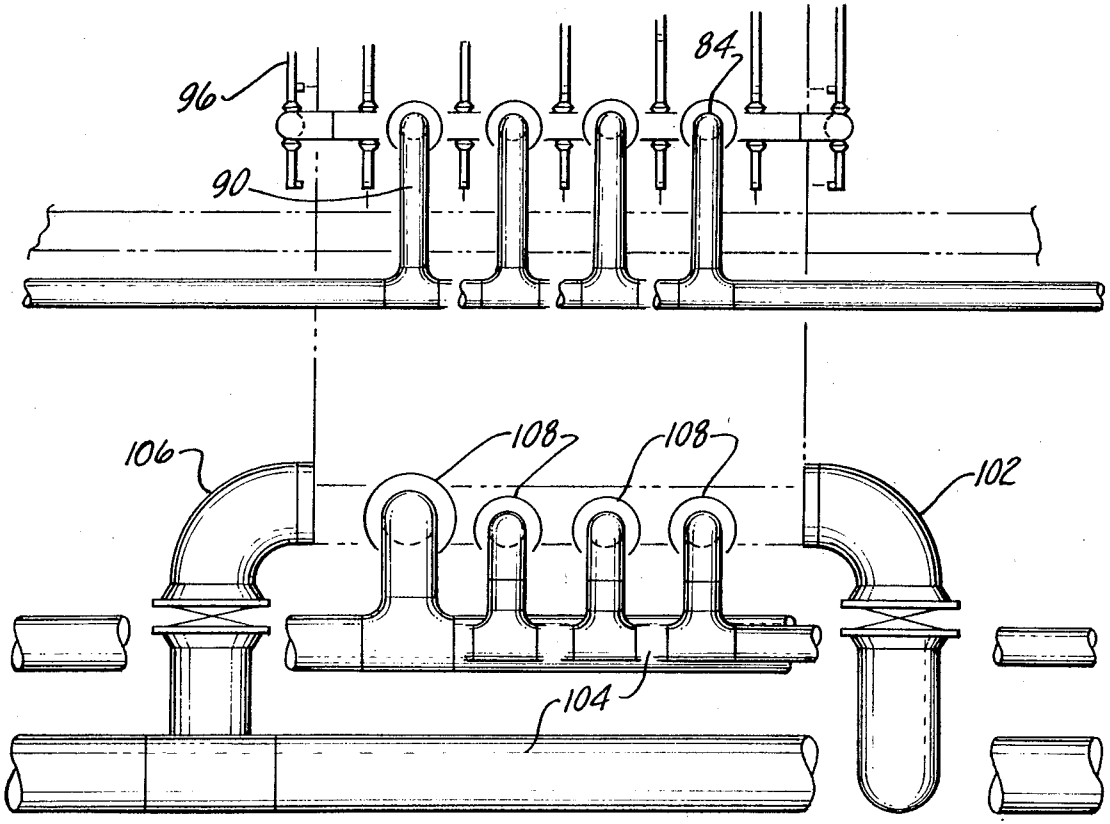
FIG. 5 is a front view of one of the process utilized in the chemical processing facility.

Referring to FIGS. 4 and 5, the connector pipes 90 for each of the supply tanks 30–36 are mounted on a spray header 94 which prefereably surrounds each of the process tanks 10–21. A plurality of conventional elongate spray nozzles 96 are mounted on the spray header 94 in order to provide a stream of spray to the process tanks 10–21.

Figure 3:
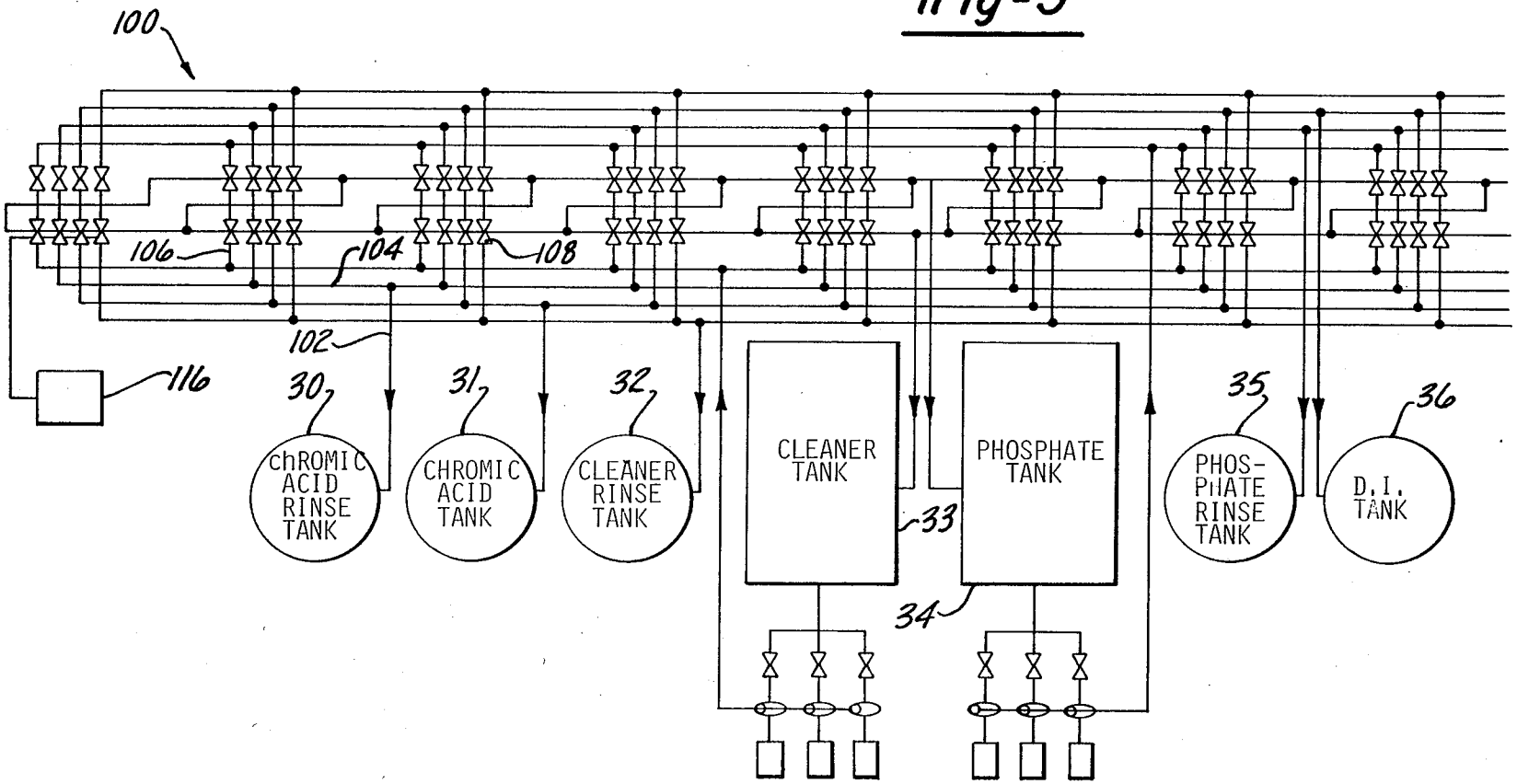
FIG. 3 is a schematic of the drainage conduit network.

Referring to FIG. 3, a second pipe network 100 is provided for draining the chemical solution from each of the process tanks 10–21 and disposing of the chemical solution or returning it to its original supply tank. Each of the supply tanks 30–36 receives chemical solution discharged from each of the process tanks 10–21 through a network preferably comprising a return pipe 102 which communicates with a supply tank and a principal discharge pipe 104. The principal discharge pipe 104 is in turn connected to each of the process tanks 10–21 by a series of discharge connector pipes 106.

Butterfly valves 108 are preferably mounted on each of discharge connector pipes 106 at the exit point of the process tanks 10–21. Selective activation of the butterfly valves 108 allows for routing of particular chemical solution in a particular process tank 10–21 to the desired return location. The return location is normally the original supply tank that provided that chemical solution. However, some or all of the chemical solution being discharged from a particular process tank may be routed for disposal through waste pipe 110. Since each of the butterfly valves 108 acts independently of the others, it is possible to selectively discharge the solution from any one or more of the process tanks 10–21 to any one selected supply tank 30–36 or to the waste pipe 110.

Referring again to FIGS. 4 and 5, the various return connector pipes 106 each communicate with the process tank header 112 located in the bottom portion of each of the process tanks 10–21.

It should be noted that, supply pipes 114 and 116 are also connected to the process tank header 112. In the preferred embodiment, these supply pipes provide cleaner and phosphate solution to the process tank header in addition cleaner and solution supply pipes which communicate with the spray header 94 in the upper portion of the tank. It will be appreciated by those skilled in the art that the process tank header 112 and the spray header 94 may be simultaneously utilized as supply sources for any chemical solution whenever desirable. Thus, where it is desired that the part be completely immersed in a particular solution, that solution may be routed into the process tank through the process tank header 112 and, where it is desired that the part be sprayed with a particular solution, that solution may be introduced into the tank through the spray header 94.

Referring again to FIGS. 3 and 4, an automatic programmable controller 116 is utilized to activate one or more of the butterfly waves 108. Depending on the level of sophistication of the controller, one or more of the operations of the process may be automated. For example, if all of the butterfly valves 108 are activated and deactivated by the automatic programmable controller 116, each of the chemical solutions will automatically be supplied and discharged from each of the process tanks 10–21, thus fully automating the system.

A more sophisticated automatic programmable controller 116 may be employed for automatically activating and deactivating selected butterfly valves to route any one of the solutions to or from one or more selected process tanks while simultaneously routing another solution to or from one or more other process tanks. It should be noted that, with a relatively sophisticated controller of this type, any one of the solutions may be supplied or discharged to any one of the process tanks at a particular time. Thus, the processing times of the tanks can be staggered so that a single one of the process tanks 10–21 periodically becomes available. For example, if the total processing time were 10 minutes and there were 10 process tanks, the processing schedule of each of the tanks could be staggered so that a single tank is ready to receive an untreated part every minute.

Figure 6:
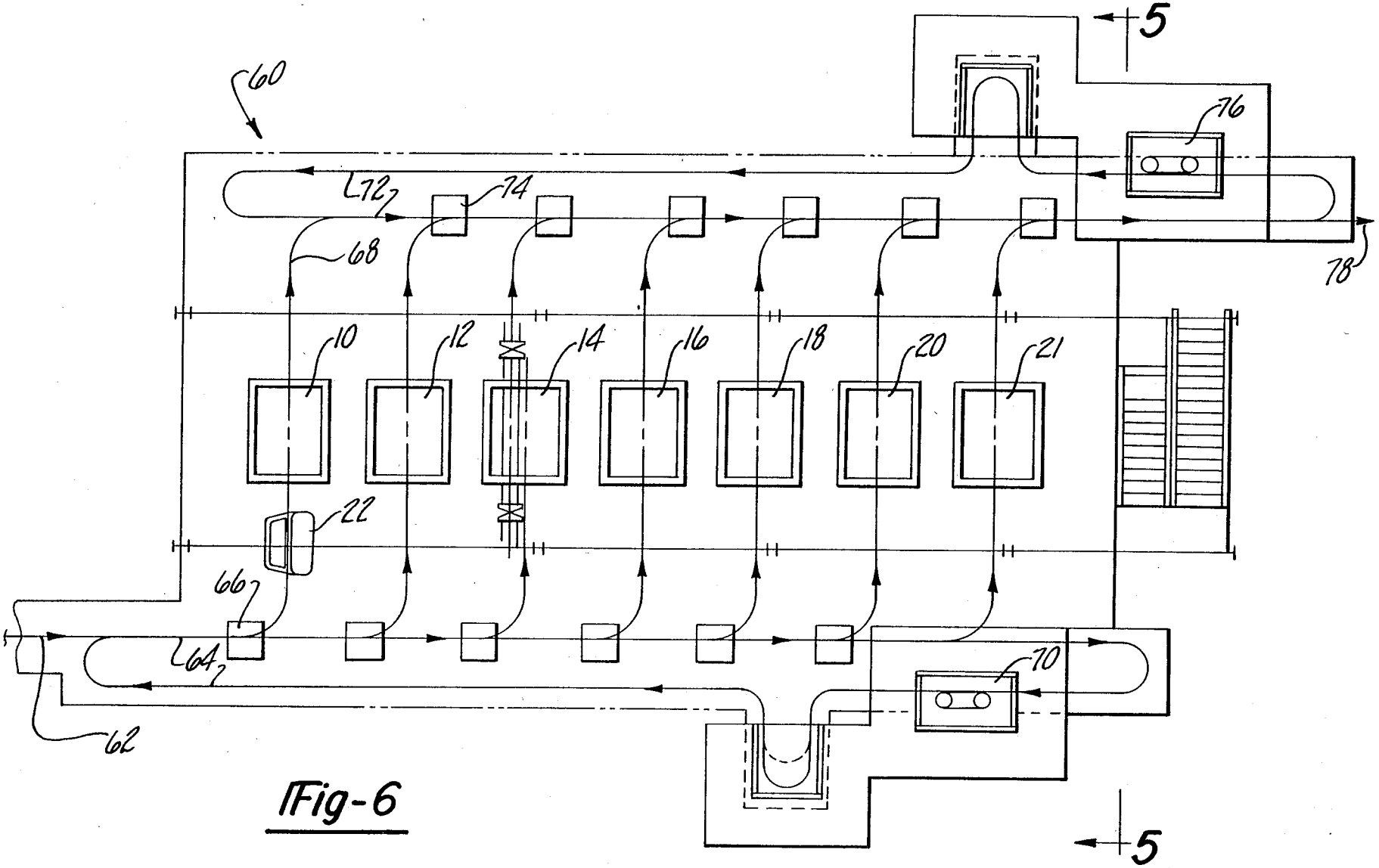
FIG. 6 is an overhead view of the chemical processing system and associated conveyor lines.

Referring to FIG. 6, a parallel conveyor system, generally referred to by the numeral 60 is provided for supplying each of the auto bodies to the process tank 10–21. The parts 22 are typically conveyed in serial fashion into the system at point 62. The parts then move into the first loop 64 of the conveyor line. The next part to be treated moves through the loop until it reaches an unused tank. The part then leaves the first loop 64 of the conveyor line at the junction point 66 of the first loop 64 and one of the parallel tank supply lines 68 where it is conveyed to the process tank 10 for processing. The next part on the incoming line 62 is then routed along the first loop 64 of the conveyor line until it reaches the junction point of the next unused process tank 10–21.

In the event that all the tanks are being used when the next part enters the system, that part can be recirculated through the first loop 64 of the conveyor line until such time as a process tank 10–21 is ready to process it. It should be noted that the first loop 64 of the conveyor line is long enough to accommodate a relatively large number of untreated parts. This is especially useful when one or more of the process tanks 10–21 break down or are shut down for maintenance.

When one of the individual parts 22 has undergone a complete processing cycle, it is conveyed by its parallel tank supply line 68 to the second loop 72 of the conveyor line. The finished parts are then conveyed from the second loop 72 of the conveyor line to the terminal point 78 of the system where they are conveyed in series to the next worksight on the assembly line. In the event that the conveyor line has stopped at some point beyond the terminal point 78 of the system line, the finished parts can be accumulated along the length of the second loop 72 of the system conveyor line. Thus, if the assembly line shuts down at some point past the terminal point 78 of the system, the parts 22 that are undergoing processing may be removed from the process tanks 10–21 as soon as they complete the processing cycle.

It will be appreciated by those skilled in the art that the conveyor system of the present invention may be directly connected to the serial conveyor line, facilitate the parallel processing of parts received from the serial conveyor line, and return the processed parts to the next worksight for further serial processing with maximum efficiency. Furthermore, utilization of the first loop 64 and second loop 72 in the conveyor system provides for a smooth transition from serial processing to parallel processing and back again and allows for adequate space for accumulation of the parts in the event of a shutdown at either the input or output end of the system.

In the preferred embodiment, the automatic programmable controller 116 is connected to each of the butterfly valves 108 for the waste discharge pipe 110 and one or more of the butterfly valves 108. The automatic controller 116 can then be programmed to activate and deactivate the butterfly valves 108 in order to route a preselected portion of a chemical solution being drained from the process tanks 10–21 to the waste pipe 110, and the remaining portion of the chemical solution back to its original supply tank. This automatic siphoning off of a preselected portion of the chemical solution being emptied from the tanks 10–21 is particularly useful when the bulk of the contaminants in the solution settle to the bottom of the tank. Under these circumstances, the first portion of the chemical solution can be routed to the waste pipe 110 and the remaining, less contaminated portion of the chemical solution can be returned to its original supply tank 30–36.

We claim:

1. A method for subjecting articles arriving in series on a conveyor line to surface treatment by a sequence of solutions, the method including:

(A) introducing the untreated articles arriving in series on the conveyor line respectively and in parallel into a plurality of process tanks;

(B) routing a solution from a supply tank connected by conduit means to each of the process tanks, to each of the process tanks by activating a first series of valves;

(C) subjecting each of the articles in each of the process tanks to the solution for a preselected period of time;

(D) discharging the solution from the process tanks through second conduit means to its supply tank by activating a second series of valves;

(E) repeating steps C and D until the articles have been subjected to each of the solutions utilized in the process;

(F) removing each of the now treated articles from its respective process tank and returning those articles in series to the conveyor line for transport to the next step in the production; and (G) continuously repeating steps A through F for the untreated articles arriving in series on the conveyor line.

2. The method of claim 1 wherein the first and second series of valves are activated to selectively route any one of the chemical solutions to or from one or more selected process tanks and simultaneously route any other chemical solution to or from one or more other process tanks so that the chemical processing schedule of one process tank is staggered with respect to another process tank.

3. The method of claim 1 wherein the second series of valves is activated to route a desired portion of the chemical solution from a particular process tank to a disposal tank and routing the remaining portion of the chemical solution back to its supply tank.

4. Apparatus for subjecting articles to surface treatment of a sequence of solutions, including:

a plurality of process tanks positioned at a processing station;

a plurality of supply tanks positioned at said processing station, each supply tank containing one of the solutions utilized in the process;

first conduit means for supplying solutions contained in each supply tank to each of the process tanks, the first conduit means including a first series of valves for routing a selected solution in a particular supply tank to each of the process tanks;

second means for draining the solution from each of the process tanks, the second conduit means including a second series of valves for routing the solution from each of the process tanks into a particular supply tank;

control means connected to the first and second series of valves for automatically activating and deactivating the valves in a programmed sequence so that the articles introduced into each of the process tanks are subjected to each of the solutions in a programmed sequence;

means for delivering the articles in series to a location upstream from said processing station;

means for passing the articles in parallel through said processing station by delivering articles arriving successively at said upstream location to respective process tanks; and means located downstream of said processing station for receiving the articles following their passage in parallel through said processing station and operative to move the articles away from said processing station in series relationship.

5. The apparatus of claim 4 wherein the control means is operative to activate and deactivate said valves to selectively route any one of the solutions to or from one or more selected process tanks and simultaneously route any other solution to or from one or more other process tanks.

6. The apparatus of claim 4 including at least one disposal tank and wherein the control means is operable to automatically route a preselected portion of the solution from a particular process tank to the disposal tank and route the remaining portion of the solution back to its supply tank.

7. The apparatus of claim 4 wherein the articles are automobile bodies.

8. The apparatus of claim 4 wherein the solutions include chromic acid, chromic acid rinse, cleaner, cleaner rinse, phosphate, and phosphate rinse.

9. The apparatus of claim 4 including a multi-level skeletal support structure adapted to support each of the supply tanks on a first level and each of the process tanks on a second level vertically displaced from the first level.

10. Apparatus for subjecting articles to surface treatment of a sequence of solutions, including:

a plurality of process tanks;

a plurality of supply tanks, each supply tank containing one of the solutions utilized in the process;

first conduit means for supplying solutions contained in each supply tank to each of the process tanks, the first conduit means including a first series of valves for routing a selected solution in a particular supply tank to each of the process tanks;

second conduit means for draining the solution from each of the process tanks, the second conduit means including a second series of valves for routing the solution from each of the process tanks into a particular supply tank;

control means connected to the first and second series of valves for automatically activating and deactivating the valves in a programmed sequence;

a first conveyor line conveying the articles in series to the process tanks, the first conveyor line having an input end and an output end;

first parallel conveyor means for removing an article from the output of the first conveyor line and routing that article to an unoccupied process tank;

a second conveyor line for transporting the articles in series to the next production station, the second conveyor line having an input end and an output end; and second parallel conveyor means for removing an article from a process tank and transporting that article from a process tank and transporting that article to the input end of the second conveyor line;

whereby the next untreated article on the output end of the first conveyor line is routed by the first parallel conveyor means to one of the process tanks, immersed in the process tank, subjected to each of the solutions in a programmed sequence, and transported by the second parallel conveyor means to the second conveyor line.

* * * * *

UNITED STATES PATENT AND TRADEMARK OFFICE

CERTIFICATE OF CORRECTION

PATENT NO. : 4,568,576

DATED : February 4, 1986

INVENTOR(S) : Clarence Minnie et al.

It is certified that error appears in the above-identified patent and that said Letters Patent is hereby corrected as shown below:

Column 5, line 22, "waves" should read -- valves --.

Signed and Sealed this

*Sixteenth* Day of *September 1986*

[SEAL]

*Attest:*

DONALD J. QUIGG

*Attesting Officer*

*Commissioner of Patents and Trademarks*